United States Patent [19]

Lightle

[11] 4,234,293

[45] Nov. 18, 1980

[54] AXIAL BALANCING SYSTEM FOR MOTOR DRIVEN PUMPS

[75] Inventor: John R. Lightle, Cypress, Calif.

[73] Assignee: Dresser Industries, Inc., Dallas, Tex.

[21] Appl. No.: 24,358

[22] Filed: Mar. 27, 1979

[51] Int. Cl.[3] ..... F04B 17/00; F04B 35/04

[52] U.S. Cl. ..... 417/365; 417/357; 417/902

[58] Field of Search ..... 417/357, 365, 902

[56] References Cited

U.S. PATENT DOCUMENTS

| | | | |
|---|---|---|---|
| 1,146,079 | 7/1915 | Krogh | 415/106 |
| 2,809,590 | 10/1957 | Brown | 417/365 X |
| 3,067,690 | 12/1962 | Kramer et al. | 417/357 |
| 3,115,839 | 12/1963 | Pollak et al. | 417/368 |
| 3,135,211 | 6/1964 | Pezzillo | 417/365 X |
| 3,138,105 | 6/1964 | White | 417/357 |
| 3,220,350 | 11/1965 | White | 417/365 X |
| 3,225,698 | 12/1965 | Spisiak | 417/365 X |
| 3,288,073 | 11/1966 | Pezzillo | 417/365 X |
| 3,413,925 | 12/1968 | Campolong | 417/365 X |
| 4,065,231 | 12/1977 | Litzenberg | 417/365 X |

*Primary Examiner*—Philip R. Coe

*Attorney, Agent, or Firm*—John N. Hazelwood; Roy L. Van Winkle

[57] ABSTRACT

The pump described is of the canned motor type generally used for handling caustic materials where the motor is integrated into the pump, but must be totally sealed therefrom. The pump rotor is mounted on a hollow shaft that is supported by bearings on a hollow mandrel which has one end secured to the pump housing and the other end secured to a lug projecting from a rear shaft support plate. The lug is hollow and is provided with a plurality of ports that provide fluid communication between the motor housing and the pump inlet through the hollow mandrel. The shaft is arranged, when moved axially by the thrust developed by the centrifugal pump to open and close the ports regulating flow therethrough and thereby exerting a force on the shaft to counteract the thrust force generated during pumping.

3 Claims, 2 Drawing Figures

AXIAL BALANCING SYSTEM FOR MOTOR DRIVEN PUMPS

BACKGROUND OF THE INVENTION

This invention relates generally to an improved motor driven centrifugal pump. More particular, but not by way of limitation, this invention relates to an improved axial balancing system for such pumps.

Various schemes have been proposed in the past for utilizing the fluid being pumped to balance the axial thrust developed by the centrifugal pump. One of such schemes is disclosed in U.S. Pat. No. 4,065,231 issued to David P. Litzenberg on Dec. 27, 1977. While the system described in that patent operates generally satisfactory, it has been observed that pumping occurs adjacent the balancing ports during operation of the pump, impending fluid flow through the ports and thereby creating a net axial force on the motor rotor and shaft toward the pump rotor.

Accordingly, an object of this invention is to provide an improved axial balancing system that functions to provide automatic and effective axial balancing of the forces generated by the pump rotor during operation.

SUMMARY OF THE INVENTION

This invention provides an improvement to an axial balancing system for a motor driven centrifugal pump that includes a pump motor and housing, a hollow mandrel having one end mounted in the pump housing, a hollow rotor shaft rotatable and axially movable on the mandrel, and a bearing located near each end of the mandrel between the shaft and the mandrel. The improvement comprises a hollow support plate located in the motor housing and a hollow lug projecting from the plate toward the mandrel. The lug has an outer diameter sized to movably receive the motor rotor shaft and an interior sized to fixedly receive the other end of the mandrel. The lug also has a plurality of ports therein providing fluid communication between the interior of the motor housing and the interior of the mandrel. The ports are located in positions where they can be covered and uncovered by the rotor shaft during axial sliding movement thereof as axial thrust is generated by the pumping of fluid by the pump. The lug also has an annular end face engageable with one of the bearings to limit the axial movement of shaft toward the support plate.

BRIEF DESCRIPTION OF THE DRAWING

The foregoing and additional objects and advantages of the invention will become more apparent as the following detailed description is read in conjunction with the accompanying drawing, wherein like reference characters denote like parts in all views and wherein.

DETAILED DESCRIPTION OF THE PREFERRED EMBODIMENT

Figure 1:
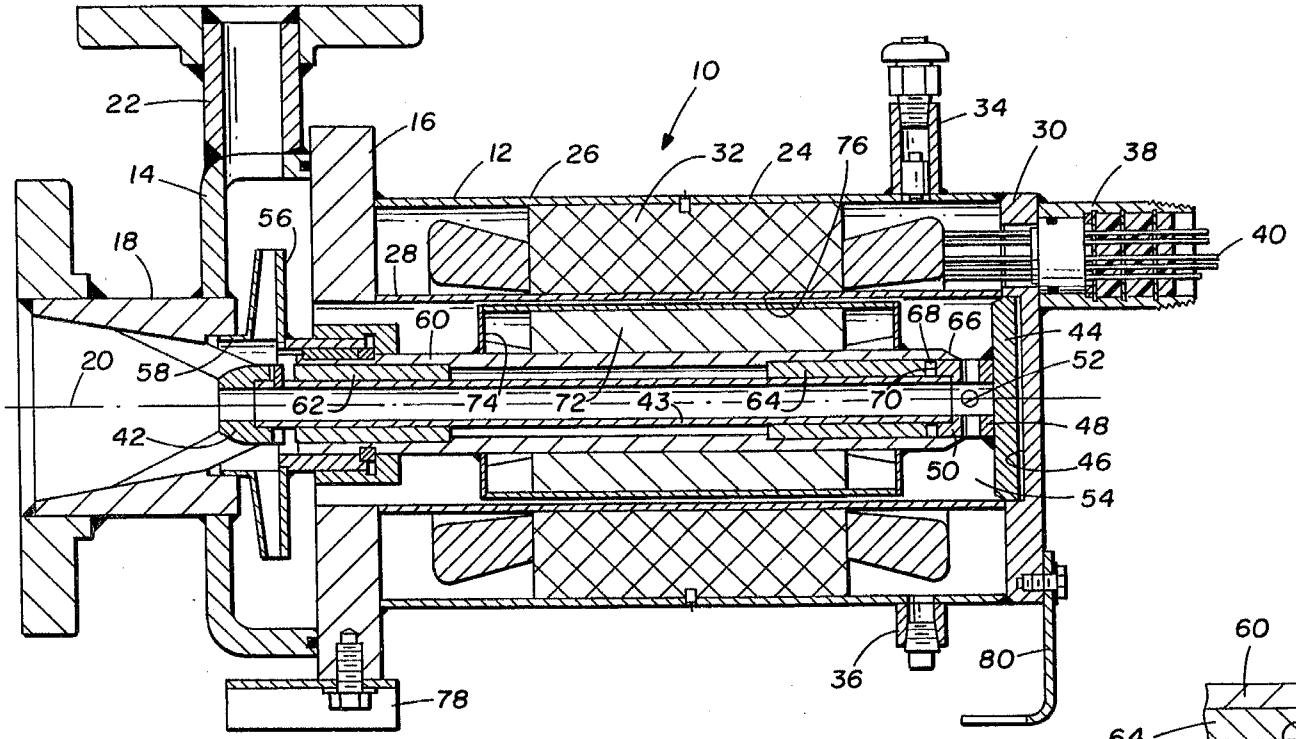
FIG. 1 is a longitudinal, cross-sectional view of a pump including the improved axial balancing system that is constructed in accordance with the invention.

Referring to the drawing, and to FIG. 1 in particular, shown therein and generally designated by the reference character 10 is a motor driven pump that is constructed in accordance with the invention. The pump 10 includes a motor housing 12 and a pump housing 14 that are interconnected by a post or post disc 16. The pump housing 14 includes an inlet member 18 that is located on the axial center line 20 of pump 10. An outlet member 22 is suitably connected to the pump housing 14 and is provided for the discharge of fluid from the pump 10.

The motor housing 10 includes a motor stator housing 24 that consists of concentric members 26 and 28 that are joined to the post 16 at one end and to an end wall 30 at the other end. Disposed within the annular space formed by the members 26 and 28 is a motor stator 32. An inlet fitting 34 and an outlet fitting 36 are provided so that suitable insulating and cooling fluid can be placed in the annular cavity between the members 26 and 28 and surrounding the motor stator 32. An electrical outlet 38 is provided in the end wall 30 and is arranged to hermetically seal the annular cavity between the members 26 and 28 while permitting the necessary electrical connections 40 to extend therethrough.

The pump end 42 of a fixed hollow mandrel 43 is suitably supported on the inlet member 18 while the opposite end thereof is supported by a rear shaft support plate 44 that is disposed within a recess 46 formed in the end wall 30.

A hollow lug 48 is illustrated as being welded to the rear shaft support plate 44, but may be formed as an integral part thereof if desired. The lug 48 is hollow and is counterbored to receive the motor end 50 of the hollow mandrel 43. The lug 48 is provided with a plurality of ports 52 that extend therethrough providing fluid communication from a cavity 54 encircling the lug 48 within the motor housing 24 to the interior of the hollow mandrel 43.

As previously mentioned, the mandrel 43 is fixed. A pump rotor 56 is located within the pump housing 14 and includes a front shroud or wear ring 58 that defines the inlet into the rotor 56 and places the rotor 56 in communication with the pump inlet 18. The rotor 56 is attached to a rotatable shaft 60 that encircles the mandrel 43 and has a pair of spaced bearings 62 and 64 located between the shaft 60 and the mandrel 43 to provide for rotation of the shaft 60 and the attached rotor 56. The shaft bearings and rotor are movable axially to a limited extent on the mandrel 43.

It should be noted that the end of the shaft 60 opposite that to which the rotor 56 is attached, is provided with a bevel 66 and terminates short of the ports 52 when the rotor 56 is in the leftmost position thereof. A small gap 68 is illustrated between the bearing 64 and the face 70 of the lug 48. The gap 68 is of a pre-determined size so that as the rotor 56 and shaft 60 move axially toward the right as illustrated in the drawing, the shaft will be stopped upon engagement of the bearing 64 with end face 70 of the lug 48. Such engagement occurs prior to disengagement of the wear sleeve 58 from the inlet member 18.

Encircling the shaft 60 is a motor rotor winding 72 that is encased in a hermetically sealed canister 74. Between the exterior of the canister 74 and the interior member 28 of the motor stator housing 24, there is provided an annular space 76 for purposes that will become more apparent hereinafter.

In addition to the foregoing, it will be noted that the pump 10 is also provided with suitable mounting brackets, such as the mounting bracket 78, which is attached to the post 16 and a mounting bracket 80 which is attached to the end wall 30.

In operation, the pump 10 is manifolded into the fluid system (not shown) as well as being connected to a source of energy (not shown). Upon starting, the shaft 60 is caused to rotate as a result of its connection with the motor rotor 72. Rotation of the shaft 60 imparts rotation to the pump rotor 56 bringing fluid into the inlet member 18 and discharging fluid from the pump rotor 56 outwardly through the outlet member 22.

As the rotor spins, pressure of the fluid going through the pump 10 builds up within the pump housing 14 and enters into the motor housing 12 through the post 16. More specifically, the fluid is located within the inner member 28 of the motor housing. The gap 76 which is located between the canister 74 and the inner member 28, permits fluid to move into the cavity 54 at the rear of the motor housing. The gap 76 functions as a fixed orifice metering the flow of fluid therethrough. The pressure increases in the cavity 54, flows through the balancing ports 52 and passes outwardly through the interior of the hollow mandrel 43 into the inlet member 18.

During the operation, axial thrust is generated by the pump rotor 56 that causes the pump rotor 56, motor rotor 72 and the shaft 60 to move axially toward the right as viewed in FIG. 1. As this occurs, the end of the shaft 60 adjacent the bevel 66 starts to close the ports 52 in the lug 48, impeding flow from the cavity 54 in the motor housing 24.

Figure 2:
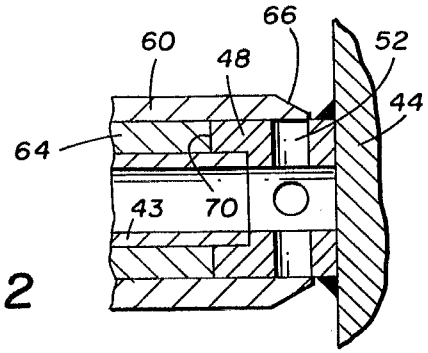
FIG. 2 is an enlarged, partial, cross-sectional view of a portion of the improved balancing system of FIG. 1 showing the rotor shaft in an axially displaced position as compared to FIG. 1

Axial movement continues toward the position shown in FIG. 2 until sufficient pressure is built up in the cavity 54 to balance the thrust generated by the pump rotor 56. The gap 68, as previously mentioned, has been made a predetermined size so that the rightward axial movement of the shaft 60, motor rotor 72 and the pump rotor 56 will stop when the bearing 64 engages the face 70 of the lug 48 and prior to the wear sleeve 58 moving out of the inlet member 18.

Since the flow is impeded through the ports 52, pressure increase in the cavity 54 exerts an axial pressure on the motor rotor 72 and moves the rotor 72, shaft 60 and pump rotor 56 axially toward the left as seen in FIG. 1 until a balanced condition is attained.

It should be pointed out that in the prior art structure, the shaft end and bearing adjacent to the balancing ports cause pumping of the fluid in the cavity that inhibits the flow of fluid from the cavity into the mandrel through the ports. Thus, the operation of the balancing system is not totally effective since pressure maintained in the cavity tends to bias the pump rotor, motor rotor and shaft to the left as illustrated in the drawing at all times.

From the foregoing detailed description, it will be appreciated that the improvement to the balancing system described in detail hereinbefore provides a means for effectively balancing the axial thrust generated as the pump operates. It will be appreciated also that many changes and modifications can be made from the apparatus described in detail hereinbefore without departing from the spirit of the invention.

The embodiments of the invention in which an exclusive property or privilege is claimed are defined as follows:

1. An improvement to an axial balancing system for a motor driven centrifugal pump including a pump and motor housing, a hollow mandrel having one end mounted in the pump housing, a hollow rotor shaft rotatable and axially movable on the mandrel, a bearing located near each end of the mandrel between the shaft and mandrel, said improvement comprising:

a support plate located in the motor housing;

a hollow lug projecting from said plate toward said mandrel, said lug having an outer diameter sized to movably receive the rotor shaft and an interior sized to fixedly receive the other end of the mandrel, and said lug having a plurality of ports therein providing fluid communication between the interior of the motor housing and the interior of the mandrel, said ports being located in positions to be covered and uncovered by the rotor shaft during axial movement thereof as axial thrust is generated by the pumping of fluid by the motor pump; and, said lug having an annular end face engageable with one of the bearings to limit the axial movement of the shaft toward said support plate.

2. The improvement of claim 1 wherein the exterior of the end of the rotor shaft is bevelled to reduce pumping by the shaft and facilitate flow through said ports.

3. The improvement of claim 2 wherein the bearing adjacent said plate is enclosed within said mandrel, shaft and lug.

* * * * *